US010744359B1

(12) United States Patent
Pottier et al.

(10) Patent No.: US 10,744,359 B1
(45) Date of Patent: Aug. 18, 2020

(54) CLIMATE CHANGE REDUCING MALODOROUS COMPOSITION OF MATTER AND WARNING SYSTEM

(71) Applicants: Charles Pottier, Scottsdale, AZ (US); Jason Smith, Edmonds, WA (US)

(72) Inventors: Charles Pottier, Scottsdale, AZ (US); Jason Smith, Edmonds, WA (US)

( * ) Notice: Subject to any disclaimer, the term of this patent is extended or adjusted under 35 U.S.C. 154(b) by 0 days.

(21) Appl. No.: 16/582,937

(22) Filed: Sep. 25, 2019

(51) Int. Cl.

| | |
|---|---|
| ***A62D 9/00*** | (2006.01) |
| ***C11B 9/00*** | (2006.01) |
| ***E21F 17/18*** | (2006.01) |
| ***A62D 1/00*** | (2006.01) |

(52) U.S. Cl.
CPC ..... *A62D 9/00* (2013.01); *C11B 9/0076* (2013.01); *A62D 1/00* (2013.01); *C11B 9/0011* (2013.01); *E21F 17/18* (2013.01)

(58) Field of Classification Search
CPC ..... C11B 9/0011; C11B 9/0076; E21F 17/18; A62D 1/00; A62D 9/00
See application file for complete search history.

(56) References Cited

U.S. PATENT DOCUMENTS

| | | | | |
|---|---|---|---|---|
| 1,438,463 A | | 12/1922 | Saner | |
| 2,468,369 A | | 4/1949 | Jones | |
| 2,894,478 A | | 7/1959 | Reed et al. | |
| 3,767,591 A | | 10/1973 | Selleck | |
| 3,861,350 A | | 1/1975 | Selleck | |
| 4,954,271 A | * | 9/1990 | Green | A62D 1/0057 169/46 |
| 5,102,557 A | * | 4/1992 | Nimitz | A62D 1/0057 169/46 |
| 5,512,285 A | * | 4/1996 | Wilde | B01D 11/0288 424/756 |
| 5,552,088 A | * | 9/1996 | Pottier | A62D 9/00 116/214 |
| 5,716,011 A | * | 2/1998 | Barbier | A61L 9/04 239/8 |
| 5,778,984 A | * | 7/1998 | Suwa | A62C 19/00 169/36 |

(Continued)

FOREIGN PATENT DOCUMENTS

CA 2259346 A1 1/1999

OTHER PUBLICATIONS

William H. Pomroy and Terry L. Muldoon; "Improved Stench Fire Warning for Underground MInes"; United States Department of Interior; Bureau of Mines Information Circular 1985; Information Circular 9016.

*Primary Examiner* — Nimeshkumar D Patel
*Assistant Examiner* — Tania Courson
(74) *Attorney, Agent, or Firm* — A. David Logan; Venjuris, P.C.

(57) ABSTRACT

A climate change reducing malodorous composition of matter that contains a liquid mercaptan mixed with a solvent, trans-1,3,3,3-tetrafluoroprop-1-ene, and a flame suppression component, trans-1-chloro-3,3,3-trifluoropropene, and with an inert gas such as nitrogen or carbon dioxide under pressure in a container for introduction into a pressurized breathing or pneumatic tool system, such as in mines, thereby forming a warning system to warn a person of danger when the malodorous composition of matter is released from the container.

19 Claims, 1 Drawing Sheet

(56) References Cited

U.S. PATENT DOCUMENTS

| | | | | |
|---|---|---|---|---|
| 5,944,873 | A * | 8/1999 | Jager | A62B 9/00<br>55/DIG. 33 |
| 6,776,920 | B1 * | 8/2004 | Reed | A62D 1/00<br>169/45 |
| 6,860,998 | B1 * | 3/2005 | Wilde | C11B 9/025<br>210/136 |
| 8,734,671 | B2 * | 5/2014 | Hulse | A01N 25/06<br>252/67 |
| 10,150,146 | B2 * | 12/2018 | Elkins | B09B 1/00 |
| 2009/0283722 | A1 * | 11/2009 | Braun | C10L 3/006<br>252/408.1 |
| 2014/0131624 | A1 * | 5/2014 | Lee | G01N 33/0004<br>252/408.1 |
| 2018/0320113 | A1 * | 11/2018 | Martin | C11D 7/30 |

* cited by examiner

CLIMATE CHANGE REDUCING MALODOROUS COMPOSITION OF MATTER AND WARNING SYSTEM

BACKGROUND OF THE INVENTION

1. Field of the Invention

This invention relates to improvements in malodorous compositions of matter in conjunction with pressurized air systems to warn persons, such as miners in mines, of danger by smelling the released odor.

2. Prior Art

The malodorous compositions of matter disclosed in U.S. Pat. No. 3,861,350 used widely available nonflammable solvents which eventually were found to cause ozone depletion of the earth's atmosphere and in U.S. Pat. No. 5,552,088 used nonflammable solvents which had the potential of increasing climate change of the earth's atmosphere. These solvents all contained chlorine, and included trichloromono-fluoromethane, trichlorotrifluoroethane, 1,1,1 trichloroethane, methylene chloride, trichloroethylene, and perchloroethylene and/or 1,1,1,2-tetrafluoroethane. Applicants are unaware of any prior art combining trans-1,3,3,3-tetrafluoroprop-1-ene, as a nonflammable solvent, and trans-1-chloro-3,3,3-trifluoropropene, as a flame suppression component, for a malodorous composition of matter for use in a warning system, and which are reduce climate change over the prior art.

SUMMARY OF THE INVENTION

This invention comprises an improved warning system having a malodorous composition of matter that uses a mixture that is a nonflammable solvent in conjunction with a suitable mercaptan and an inert gas under pressure. This mixture is trans-1,3,3,3-tetrafluoroprop-1-ene, as a nonflammable solvent, and trans-1-chloro-3,3,3-trifluoropropene, as a flame suppression component.

When this mixture is mixed with a suitable mercaptan and a suitable inert gas under pressure is added, the resulting composition of matter produces a nonflammable blend which eliminates the ozone depletion problem caused by previous formulations as disclosed in U.S. Pat. No. 3,861,350 and the climate change problem caused by the previous formulation U.S. Pat. No. 5,552,088 both of which are incorporated by reference in their entities as if fully set forth herein.

Suitable mercaptans are preferably liquid at ambient temperatures and include methyl mercaptan, ethyl mercaptan, n-propyl and isopropyl mercaptan, butyl mercaptan, both secondary and tertiary, and tetrahydrothiophene.

Other suitable malodorous compounds which may be used to make up a workable malodorous composition of matter are dimethyl sulfide and ethyl iso-propyl sulfide.

Since these malodorous compounds are either flammable or explosive or both, a nonflammable solvent such as a mixture of trans-1,3,3,3-tetrafluoroprop-1-ene, as a nonflammable solvent, and trans-1-chloro-3,3,3-trifluoropropene, as a flame suppression component, is required and is essential because of its climate change reducing nature, in particular reduction of Global Warming Potential (GWP) and no ozone depletion potential (ODP). Further, this mixture has a suitable vapor pressure which is not over 80 pounds per square inch at sea level and at a maximum temperature of 25 degrees Centigrade.

Preferably, the composition of the malodorous composition of matter is a mixture of Ethyl Mercaptan trans-1,3,3,3-tetrafluoroprop-1-ene between more than 11% and less than 56%, and trans-1-chloro-3,3,3-trifluoropropene between less than 56% and more than 11%. Most preferably, the malodorous composition of matter has a composition of Ethyl Mercaptan 33% trans-1,3,3,3-tetrafluoroprop-1-ene and trans-1-chloro-3,3,3-trifluoropropene between which renders the mixture non-flammable. The malodorous composition of matter is then pressurized with an inert gas, preferably nitrogen gas.

The most suitable inert gas for use in the malodorous composition of matter is nitrogen gas. The container for the malodorous composition of matter is charged to an internal pressure of up to 500 pounds per square inch at room temperature with nitrogen gas so that sufficient pressure exists to expel the malodorous composition of matter into pressurized air breathing systems commonly maintained in mines in the United States at about 150 pounds per square inch. Carbon dioxide might also be used.

Containers used for the malodorous composition of matter must be high pressure cylinders with a capability of withstanding up to 500 pounds per square inch of pressure at sea level. Such containers may be equipped with either a high pressure needle valve which has a corrosion resistant seat, or with a ball valve having corrosion resistant capability.

The warning system is created when the container, after being filled with the malodorous composition of matter under pressure of nitrogen gas or carbon dioxide, is then equipped with an adapter and feeder tube means for connection to a valve of a pressurized air breathing system or pressurized pneumatic tool system and is then connected.

An object of this invention is to provide a malodorous composition of matter which is nonflammable and non-explosive and climate change reducing, in particular reduction of Global Warming Potential (GWP) and no ozone depletion potential (ODP).

Another object of this invention is to provide a malodorous composition of matter which can be pressured in a container with an inert gas for delivery to a pressurized air breathing system or pneumatic tool system, thereby forming a warning system.

BRIEF DESCRIPTION OF THE DRAWINGS

These and other objects will be more readily understood by reference to the following specification and claims, taken in conjunction with the accompanying drawing.

DESCRIPTION OF PREFERRED EMBODIMENTS

Example 1

Figure 1:
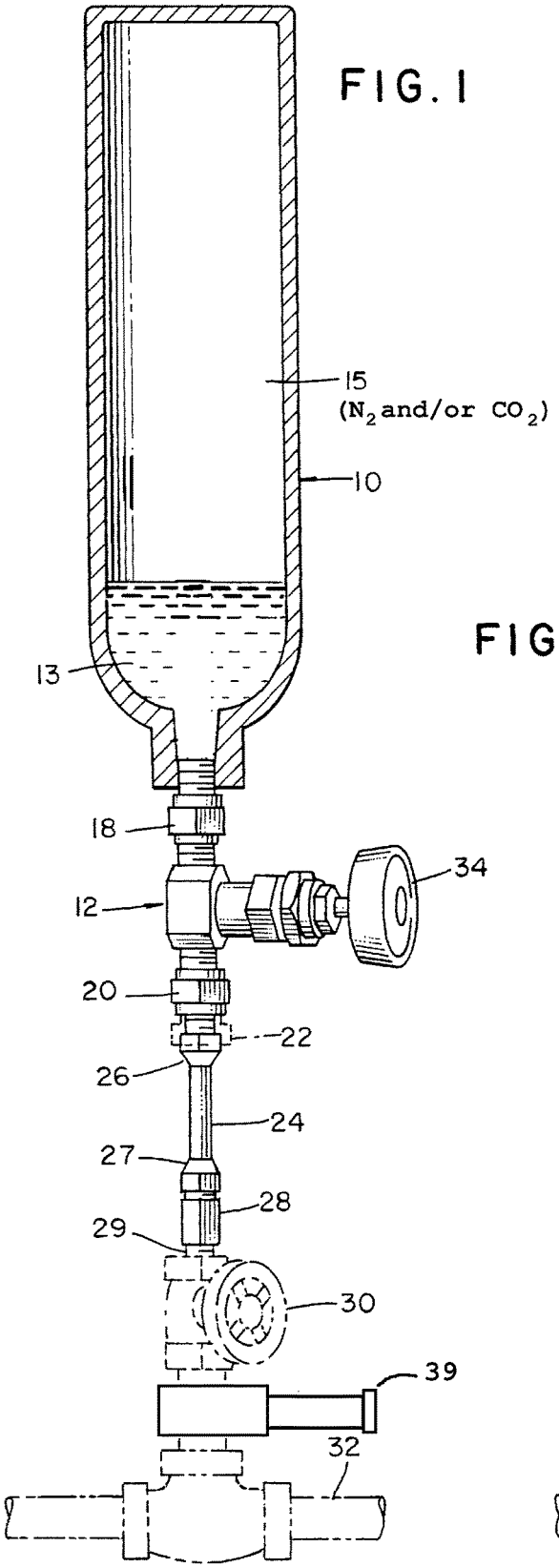
FIG. 1 of the drawing is a side elevational view of the invention with the cylinder containing the malodorous composition of matter under nitrogen or carbon dioxide gas pressure connected to a pressurized air breathing system which is shown in dotted lines. The cylinder is equipped with a needle valve.
Figure 2:
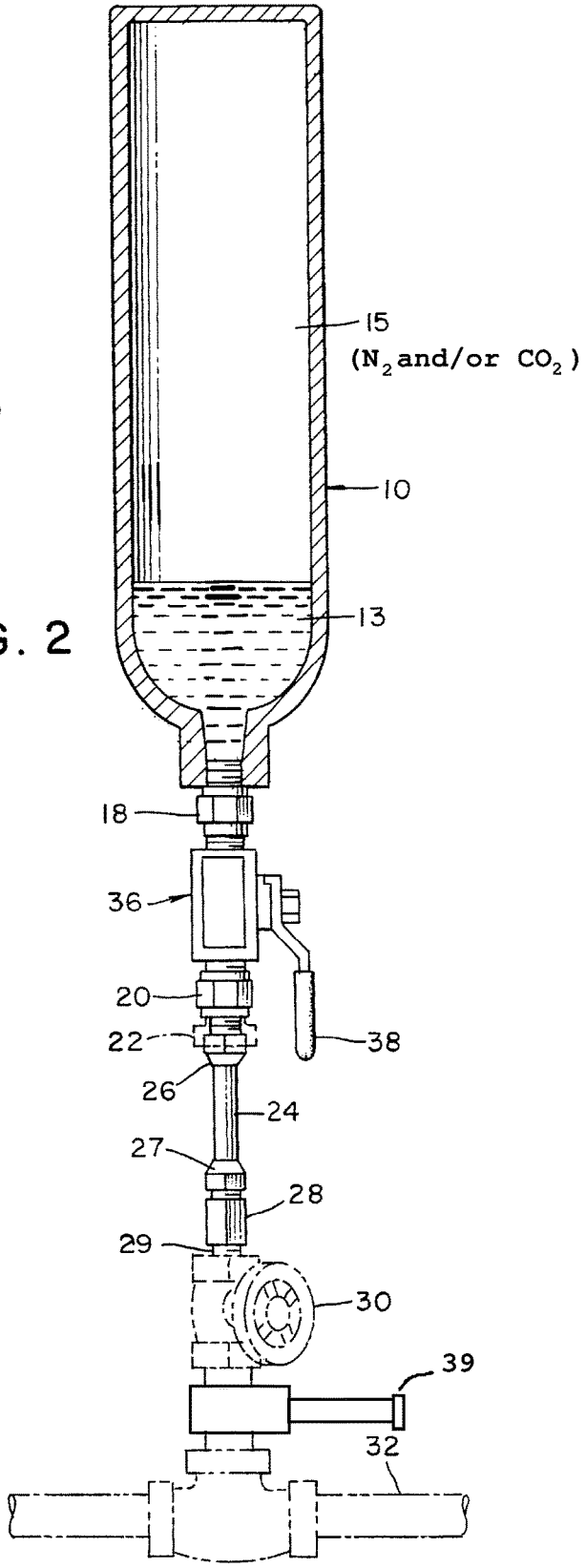
FIG. 2 is identical to FIG. 1 except that the cylinder is equipped with a ball valve.

A suitable malodorous composition of matter which is nonflammable and reduces climate change may be prepared at room temperatures with ethyl mercaptan as the malodorous ingredient and with a mixture of trans-1,3,3,3-tetrafluoroprop-1-ene, as a nonflammable solvent, and trans-1-chloro-3,3,3-trifluoropropene, as a flame suppression component.

About 100 to 500 grams of ethyl mercaptan is placed inside a high pressure cylinder 10, capable of withstanding internal pressures of from 240 to 500 pounds per square inch at sea level, and equipped with a high pressure needle valve 12. The cylinder 10 may have an internal capacity of from 75 to 189 cubic inches.

Then, from 200 to 2500 grams of a mixture of trans-1,3,3,3-tetrafluoroprop-1-ene, as a nonflammable solvent, and trans-1-chloro-3,3,3-trifluoropropene, as a flame suppression component, is added to the ethyl mercaptan in the cylinder 10 as the nonflammable and climate change reducing mixture to form the malodorous composition of matter 13.

Thereafter, nitrogen gas or carbon dioxide 15 under pressure is introduced into the cylinder 10 through needle valve 12 in an amount sufficient to produce an internal pressure of from 240 to 500 pounds per square inch, depending upon the particular capacity of the cylinder 10.

Cylinder 10 is preferably equipped with an adapter 18 whose lower end is threaded in the neck portion of cylinder 10 and closes its inner end. The adapter's upper end is threaded into needle valve 12 whose outer end receives a threaded male hexagonal connector 20. A hexagonal cap nut 22 closes the outer end of connector 20. The filled and capped cylinder 10 may then be stored at ambient temperatures until it is placed in operation.

In use, the cylinder 10 is positioned vertical with the needle valve 12 at the bottom. The cap nut 22 is removed and one end of a feeder tube 24 having a flared threaded fitting 26 is connected to the connector 20. The other end of the feeder tube 24 having a flared threaded fitting 27 is connected to an adapter 28 to pipe nipple 29 of valve 30 of the pressurized air breathing system 32 which is to receive warning. Needle valve 12 is equipped with a handle 34 to open and close it. Upon opening the needle valve 12, all of the liquid contents of the cylinder 10 will be metered into the pressurized air breathing system or pneumatic tool system 32 by metering valve 39 in short amount of time (could be as little as 5 seconds) due to the greater pressure in cylinder 10 in comparison with the air breathing system or pneumatic tool system. A substantial part of the inert nitrogen gas 15 will also be exhausted into the pressurized air breathing system or pneumatic tool system 32 until equilibrium of pressure is reached. Valve 30 of the pressurized air breathing system or pneumatic tool system 32 is then closed and if it is desired to remove the cylinder 10 from its connection to the air breathing system or pneumatic tool system 32, the needle valve 12 is closed and cylinder 10 is separated from air breathing system or pneumatic tool system 32.

For air breathing systems or pneumatic tool systems having a pressure of about 150 pounds per square inch, the above procedure producing a warning system can be performed at ambient temperatures ranging from about 50 degrees F. to about 130 degrees F. without any heating or cooling of cylinder 10 or any special preparation.

Example 2

The steps of Example 1 are repeated except for using a cylinder 10 equipped with a ball valve 36 having a handle 38 to open and close ball valve 36, instead of a needle valve 12.

The same results are obtained as in Example 1.

The ratio of parts by weight of the liquid malodorous substance and the mixture may vary from 1 part of the ethyl mercaptan to 3 parts of the mixture comprising trans-1,3,3,3-tetrafluoroprop-1-ene, as a nonflammable solvent, and trans-1-chloro-3,3,3-trifluoropropene, as a flame suppression component wherein the amount of trans-1,3,3,3-tetrafluoroprop-1-ene varies from 0.1 parts to 4.0 parts with balance of the mixture being trans-1-chloro-3,3,3-trifluoropropene to equal 1-3 parts of the mixture. The amount of inert gas may vary from 0.1 to 1.0 parts by weight, thereby producing a variance in internal pressure of a 75 cubic inch high pressure cylinder from about 240 pounds per square inch to about 400 pounds per square inch at room temperatures of about 70 degrees F. without adversely affecting the results. Suitable high pressure cylinders which are capable of withstanding such higher pressures must be used.

To use high pressure cylinders of capacities other than 75 cubic inches internally, the various amounts of ingredients may be adjusted in proportion to the increased or diminished capacity of the cylinder so that effective operating pressures may be obtained internally over the temperature range of 50 degrees to 130 degrees F.

However, the proper operation of the invention requires that the internal pressure of the charged cylinder always must be greater than that of the pressurized air breathing system that will use the invention.

Although we have described preferred embodiments of the invention, it is understood that the scope of the invention is not to be limited thereby, but numerous variations in ingredients and procedures are possible without departing from the spirit and scope of the invention as claimed herein.

What is claimed is:

1. A malodorous warning composition of matter which is nonflammable and climate change reducing for introduction into a pressurized air breathing system of a facility to warn a person of danger, comprising:

about 1-3 parts by weight of a liquid malodorous substance selected from the group consisting of methyl mercaptan, ethyl mercaptan, propyl mercaptan, butyl mercaptan, and tetrahydrothiophene;

about 1-3 parts by weight of a mixture comprising trans-1,3,3,3-tetrafluoroprop-1-ene, as a nonflammable solvent, and trans-1-chloro-3,3,3-trifluoropropene, as a flame suppression component; and from about 0.1 to about 1.0 parts by weight of an inert gas under pressure, wherein the amount of trans-1,3,3,3-tetrafluoroprop-1-ene varies with balance of the mixture being trans-1-chloro-3,3,3-trifluoropropene; and wherein the mixture has a range between 200 grams and 2500 grams; and wherein the malodorous warning composition for introduction into the pressurized air breathing system operates between 50° F. and 130° F.

2. The malodorous warning composition of matter according to claim 1 in which the inert gas is nitrogen or carbon dioxide.

3. The malodorous warning composition of matter according to claim 1 wherein the amount of trans-1,3,3,3-tetrafluoroprop-1-ene is 1-3 parts with balance of the mixture being trans-1-chloro-3,3,3-trifluoropropene.

4. The malodorous warning composition of matter according to claim 1 in which the mixture with the liquid malodorous substances is 33% by weight.

5. A malodorous warning composition of matter which is nonflammable and climate change reducing for introduction into a pressurized air breathing system of a facility to warn a person of danger, comprising:

about 1-3 parts by weight of dimethyl sulfide;

about 1-3 parts by weight of a mixture comprising trans-1,3,3,3-tetrafluoroprop-1-ene, as a nonflammable solvent, and trans-1-chloro-3,3,3-trifluoropropene, as a flame suppression component; and from about 0.1 to about 1.0 parts by weight of an inert gas under pressure, wherein the amount of trans-1,3,3,3-tetrafluoroprop-1-ene varies with balance of the mixture being trans-1-chloro-3,3,3-trifluoropropene; and wherein the mixture has a range between 200 grams and 2500 grams; and wherein the malodorous warning composition for introduction into the pressurized air breathing system operates between 50° F. and 130° F.

6. The malodorous warning composition of matter according to claim 5 in which the inert gas is nitrogen or carbon dioxide.

7. The malodorous warning composition of matter according to claim 5 in which the mixture with the liquid malodorous substances is 33% by weight.

8. A malodorous warning composition of matter which is nonflammable and climate change reducing for introduction into a pressurized air breathing system of a facility to warn a person of danger, comprising:

about 1-3 parts by weight of ethyl iso-propyl sulfide;

about 1-3 parts by weight of a mixture comprising trans-1,3,3,3-tetrafluoroprop-1-ene, as a nonflammable solvent, and trans-1-chloro-3,3,3-trifluoropropene, as a flame suppression component; and;

from about 0.1 to about 1.0 parts by weight of an inert gas under pressure, wherein the amount of trans-1,3,3,3-tetrafluoroprop-1-ene varies with balance of the mixture being trans-1-chloro-3,3,3-trifluoropropene; and wherein the mixture has a range between 200 grams and 2500 grams; and wherein the malodorous warning composition for introduction into the pressurized air breathing system operates between 50° F. and 130° F.

9. The malodorous warning composition of matter according to claim 8 in which the inert gas is nitrogen or carbon dioxide.

10. The malodorous warning composition of matter according to claim 8 wherein the amount of trans-1,3,3,3-tetrafluoroprop-1-ene is 1-3 parts with balance of the mixture being trans-1-chloro-3,3,3-trifluoropropene.

11. The malodorous warning composition of matter according to claim 8 in which the mixture with the liquid malodorous substances is 33% by weight.

12. A warning system for introducing a malodorous warning composition of matter which is nonflammable and climate change reducing into an air breathing system or pneumatic tool system of a facility having an air pressure of about 150 pounds per square inch, to warn a person therein of danger, comprising:

a high pressure container equipped with valve means at one end;

about 1-3 parts by weight of a liquid malodorous substance inside said container;

about 1-3 parts by weight of a mixture comprising trans-1,3,3,3-tetrafluoroprop-1-ene, as a nonflammable solvent, and trans-1-chloro-3,3,3-trifluoropropene, as a flame suppression component, for said liquid malodorous substance, said mixture having a maximum vapor pressure of less than 100 pounds per square inch at sea level and a temperature of about 25 degrees C. inside said container;

from about 0.1 to about 1.0 parts by weight of an inert gas under pressure inside said container, whereby a pressure of at least 240 pounds per square inch is produced inside said high pressure container, and connecting means connecting said valve means of said container to valve means of the air breathing system or pneumatic tool system of a facility; and wherein the mixture has a range between 200 grams and 2500 grams; and wherein the malodorous warning composition for introduction into the pressurized air breathing system operates between 50° F. and 130° F.

13. The warning system according to claim 12 in which the liquid malodorous substance is selected from the group consisting of methyl mercaptan, ethyl mercaptan, propyl mercaptan, butyl mercaptan, and tetrahydrothiophene.

14. The warning system according to claim 12 in which the liquid malodorous substance is a mercaptan which is a liquid at room temperature.

15. The warning system according to claim 12 in which the liquid malodorous substance is dimethyl sulfide.

16. The warning system according to claim 12 in which the liquid malodorous substance is ethyl iso-propyl sulfide.

17. The warning system according to claim 12 in which the inert gas is nitrogen or carbon dioxide.

18. The malodorous warning composition of matter according to claim 12 wherein the amount of trans-1,3,3,3-tetrafluoroprop-1-ene is 1-3 parts with balance of the mixture being trans-1-chloro-3,3,3-trifluoropropene.

19. The malodorous warning composition of matter according to claim 12 in which the mixture with the liquid malodorous substances is 33% by weight.

* * * * *